US008328573B2

(12) United States Patent
Boucher et al.

(10) Patent No.: US 8,328,573 B2
(45) Date of Patent: Dec. 11, 2012

(54) ELECTRICAL CONNECTOR

(75) Inventors: Yves Boucher, St-Jean-sur-Richelieu (CA); Guy J. A. Duval, St-Jean-sur-Richelieu (CA); Daniel Lalancette, St-Jean-sur-Richelieu (CA)

(73) Assignee: Thomas & Betts International, Inc., Wilmington, DE (US)

( * ) Notice: Subject to any disclaimer, the term of this patent is extended or adjusted under 35 U.S.C. 154(b) by 224 days.

(21) Appl. No.: 12/817,491

(22) Filed: Jun. 17, 2010

(65) Prior Publication Data

US 2010/0323542 A1 Dec. 23, 2010

Related U.S. Application Data

(60) Provisional application No. 61/218,159, filed on Jun. 18, 2009.

(51) Int. Cl.
*H01R 13/44* (2006.01)

(52) U.S. Cl. ..... 439/310; 439/137

(58) Field of Classification Search ..... 439/137, 439/310–314, 320

See application file for complete search history.

(56) References Cited

U.S. PATENT DOCUMENTS

| | | | | |
|---|---|---|---|---|
| 2,697,212 | A | 12/1954 | Castelli | |
| 2,951,138 | A | 8/1960 | Petrino | |
| 3,031,589 | A | 4/1962 | Noirclerc | |
| 3,078,435 | A | 2/1963 | Berry | |
| 3,168,624 | A | 2/1965 | Healy | |
| 3,235,682 | A | 2/1966 | Papworth | |
| 3,330,920 | A | 7/1967 | Appleton | |
| 3,599,167 | A | 8/1971 | Adrian et al. | |
| 3,853,376 | A | 12/1974 | Marechal | |
| 4,255,007 | A | 3/1981 | Michaels et al. | |
| 4,553,000 | A | 11/1985 | Appleton | |
| 4,572,601 | A | 2/1986 | Jones et al. | |
| 4,681,385 | A | 7/1987 | Kruger et al. | |
| 4,736,999 | A * | 4/1988 | Marks et al. | 439/314 |
| 4,998,891 | A * | 3/1991 | Bresko | 439/369 |
| 5,259,782 | A * | 11/1993 | Giffin | 439/367 |
| 5,267,871 | A | 12/1993 | Flanagan | |
| 5,344,333 | A * | 9/1994 | Haag | 439/320 |
| 5,352,128 | A | 10/1994 | Bricaud | |
| 5,921,794 | A | 7/1999 | Koch | |
| 6,808,407 | B1 * | 10/2004 | Cannon | 439/314 |
| 6,945,805 | B1 | 9/2005 | Bollinger | |
| 6,994,579 | B2 * | 2/2006 | Yokoigawa et al. | 439/320 |

(Continued)

FOREIGN PATENT DOCUMENTS

| | | | |
|---|---|---|---|
| CA | 2 347 042 | A1 | 3/2001 |
| CA | 2 443 343 | A1 | 3/2005 |
| CA | 2 614 990 | A1 | 1/2007 |

(Continued)

*Primary Examiner* — Thanh Tam Le

(74) *Attorney, Agent, or Firm* — Snyder, Clark, Lesch & Chung, LLP

(57) ABSTRACT

An electrical connector assembly includes a first connector including a first housing having a contact and a second connector configured for connection with the first connector, wherein the second connector includes a second housing having a conductor. The first connector is configured for connection to the second connector in at least a first position and a second position. In the first position, the first connector is connected to the second connector, and the conductor of the second connector is not in electrical contact with the contact in the first connector. In the second position, the first connector is connected to the second connector, and the conductor of the second connector is in electrical contact with the contact in the first connector.

26 Claims, 7 Drawing Sheets

U.S. PATENT DOCUMENTS

| | | | | |
|---|---|---|---|---|
| 7,081,001 | B1 | 7/2006 | Conroy et al. | |
| 7,104,826 | B2 * | 9/2006 | Zahlit et al. | 439/314 |
| 7,153,153 | B1 | 12/2006 | Conroy et al. | |
| 7,553,177 | B2 | 6/2009 | Antonini et al. | |
| 7,621,786 | B2 | 11/2009 | Yavari et al. | |
| 7,824,204 | B2 * | 11/2010 | Fujiwara et al. | 439/320 |

FOREIGN PATENT DOCUMENTS

| | | | |
|---|---|---|---|
| CA | 2 653 914 | A1 | 12/2007 |
| CA | 2 612 202 | A1 | 5/2008 |
| CA | 2 685 190 | A1 | 11/2008 |
| CA | 2 616 498 | A1 | 6/2009 |

* cited by examiner

ELECTRICAL CONNECTOR

CROSS-REFERENCE TO RELATED APPLICATION

This application claims priority under 35. U.S.C. §119, based on U.S. Provisional Patent Application No. 61/218,159 filed Jun. 18, 2009, the disclosure of which is hereby incorporated by reference herein.

BACKGROUND OF THE INVENTION

Electrical connectors are used to connect electrical devices to power sources or to join electrical circuits. Electrical connectors generally operate by connecting ground and power terminals of respective connector elements together in a manner that facilitates electrical continuity between the respective elements. In some embodiments, for example, a male connector may be inserted into a corresponding female connector to effect the connection.

In high voltage environments, additional factors may arise, such as the possibility of arcing or flashover between conducting elements of an electrical connector during connection of disconnection of the connector. These flashover or arcing events may cause injury to users, may ignite flammable or combustible gases in the ambient environment, or may damage equipment.

Accordingly, connectors in such high voltage or hazardous environments should apply power in a manner that will not damage equipment, and in a manner that provides a safe environment for users.

DETAILED DESCRIPTION OF THE PREFERRED EMBODIMENTS

The following detailed description refers to the accompanying drawings. The same reference numbers in different drawings may identify the same or similar elements.

Consistent with implementations described herein, an electrical connector may be provided that minimizes deleterious effects associated with high voltage implementations and/or hazardous environment conditions. For example, in one implementation, an electrical connector may include a male connector and a female connector, with the male connector configured for insertion into the female connector. The female connector may include an access assembly configured to prevent unintentional or undesired access to a contact assembly of the female connector. During connection, conductors in the male connector first bypass a dead front and proceed axially along the female connector to the contact assembly without electrically contacting the conductors in the contact assembly.

In one implementation, the connector may be placed into a first connected position in which the male connector is securely attached to the female connector, but with the conductors of the male connector not electrically coupled to the female connector. This may be referred to as the connected—OFF position. Additional movement of the female connector and the male connector may bring the conductors into electrical contact and may place the connector into a second connected position, referred to as the connected—ON position.

Figure 1:
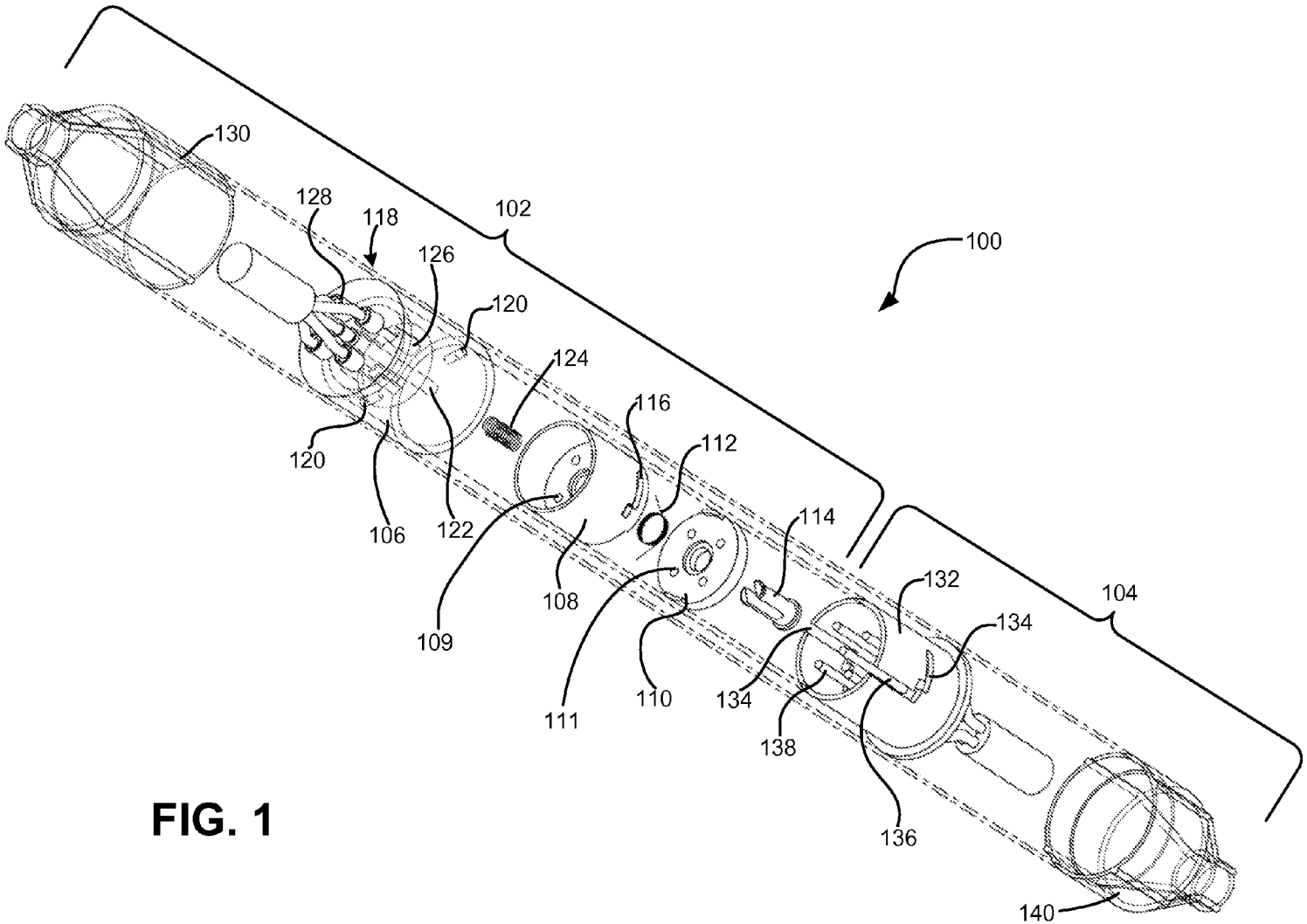
FIG. 1 is an isometric view of an exemplary embodiment of a electrical connector consistent with implementations described herein.
Figure 2:
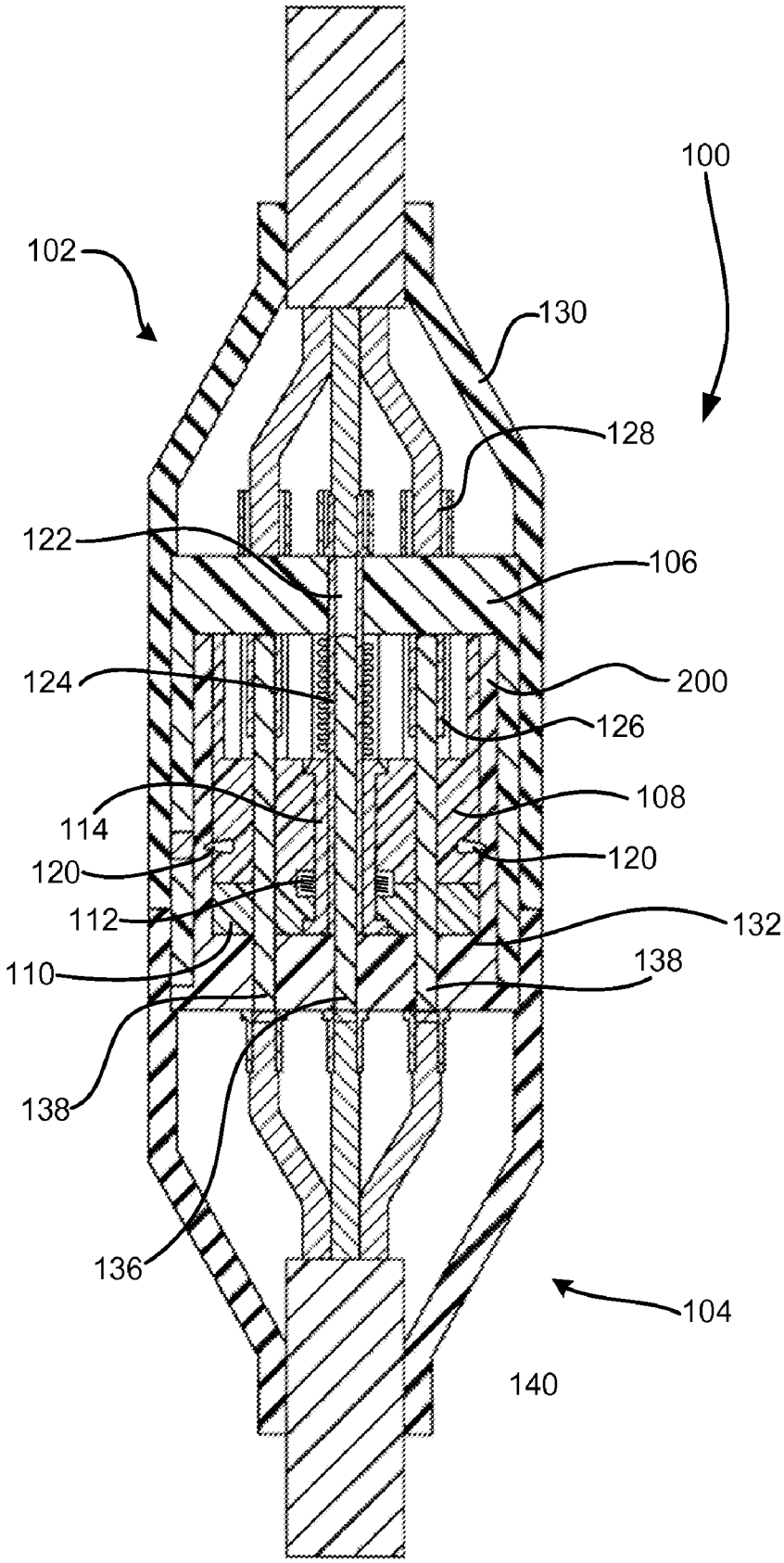
FIG. 2 is a cross-sectional view of the connector of FIG. 1 in a connected configuration.

FIG. 1 is an exploded isometric diagram illustrating an exemplary electrical connector 100 consistent with embodiments described herein. FIG. 2 is a cross-section diagram of connector 100 taken in an axial direction. As illustrated, electrical connector 100 may include a female connector 102 and a male connector 104. Female connector 102 may further include a first housing portion 106, an intermediate housing portion 108, a dead front 110, a dead front spring 112, a dead front pin 114, first notched slots 116, a contact assembly 118, guide pins 120, a center contact sleeve 122, spring 124, cup-connectors 126, contacts 128, and female cover 130. Male connector 104 may include a second housing portion 132, second notched slots 134, a center connector pin 136, connector pins 138, and a male cover 140.

As described briefly above, high voltage electrical connectors may be implemented in a variety of environments and applications. Furthermore, arcing or flashover of electricity between the contacts on the male and female sides of the connector may be possible prior to seated contact between the male and female contacts, due to the high voltages. In environments in which flammable or combustion sustaining gases (e.g., a mixture of a explosive gas and oxygen, for example) are present, such flashovers may result in catastrophic damage to personnel, equipment, and/or property. In the manner described in detail below, connector 100 may include a configuration that provides an insulating and reduced atmospheric environment between male and female contacts at the time of contact connection.

As illustrated in FIG. 1, male connector 104 may include second housing 132, center connector pin 136 and connector pins 138. As described in additional detail below, center connector pin 136 may be configured for insertion into a central hole through the components of female connector 102. In one implementation, center connector pin 136 may be configured to carry ground or common electrical signals/current. Connector pins 138 may be configured to carry current or electrical signals, such as current for high voltage electrical applications. Connector pins 138, as described more fully below, may be configured for insertion through dead front 110, intermediate housing 108, and first housing 106. Furthermore, following rotation of male connector 104 relative to female connector 102, connector pins 138 may be configured for insertion into cup-connectors 126.

Second housing 132 of male connector 104 may include notched slots 134 configured to receive guide pins 120 connected to first housing 106. Travel of guide pins through notched slots 134 may guide rotational and axial movement of female connector 102 relative to male connector 104 in a predetermined manner, as will be described in additional detail below. Male cover 140 may be formed over second housing 132 and may form a protective covering for male connector 104 as well as approximately one half of an enclosed environment for connector 100 upon connection to female connector 102.

Female connector 102, as described above, may include first housing 106, intermediate housing 108, and dead front 110. In one exemplary implementation, first housing 106, intermediate housing 108, and dead front 110 may be substantially cylindrical and may be configured to reside within female cover 130 in a substantially nested manner. More specifically, first housing 106 may include a cavity therein for receiving intermediate housing 108 and dead front 110.

In one implementation, as shown more clearly in FIG. 2, first housing 106, intermediate housing 108, and dead front 110 may be configured such that a cylindrical gap 200 is provided between an outer diameter of intermediate housing 108/dead front 110 and an inner diameter of first housing 106 when intermediate housing 108/dead front 110 is mounted axially within intermediate housing 106. Gap 200 may be of a width suitable for receiving second housing 132 of male connector 104 during connection of connector 100.

Dead front 110 may be connected axially to intermediate housing 108 via dead front pin 114. As illustrated, dead front 110 may include a flanged/notched configuration that engages a corresponding notched portion of intermediate housing 108 such that rotation of dead front 110 about dead front pin 114 is enabled within a predetermined range of motion. In addition, intermediate housing 108 and dead front 110 may be further configured to include holes 109 and 111, respectively, corresponding to a spacing of connector pins 138 in male connector 104.

In one implementation, dead front 110 may be spring-loaded with respect to intermediate housing 108, such that the holes in dead front 110 are not initially aligned with the holes in intermediate housing 108. In one exemplary embodiment, a central portion of intermediate housing 108 and dead front 110 may be recessed to receive dead front spring 112. The biasing force provided by dead front spring 112 may urge dead front 110 into a first position relative to intermediate housing 108. Rotation of dead front 110 about dead front pin 114 may oppose the biasing force of dead front spring 112 and may cause holes 111 in dead front 110 to align with holes 109 in intermediate housing 108.

Dead front 110 may operate to prevent an unintended or rushed connection of male connector 104 to female connector 102 in that a user must first insert connector pins 138 into dead front 110, rotate dead front 110 relative to intermediate housing 108 until holes 109 align with holes 111, and insert connector pins 138 further into intermediate housing 108.

In one implementation consistent with implementations described herein, the length and width of first housing 106, intermediate housing 108, and holes 109 are configured to allow potentially combustible or hot gases to vent away from contact assembly 118 during insertion or removal of connector pins 138 into female connector 102. In other implementations, holes 109 (and/or holes 111) may be filled with a conductive brush material or other assembly for increasing an efficiency of a potential flame path, in the event of an explosion in connector 100. Additional details relating to the flame path provided in connector 100 are described below in relation to FIGS. 4A-4E and 5A-5C.

Figure 3:
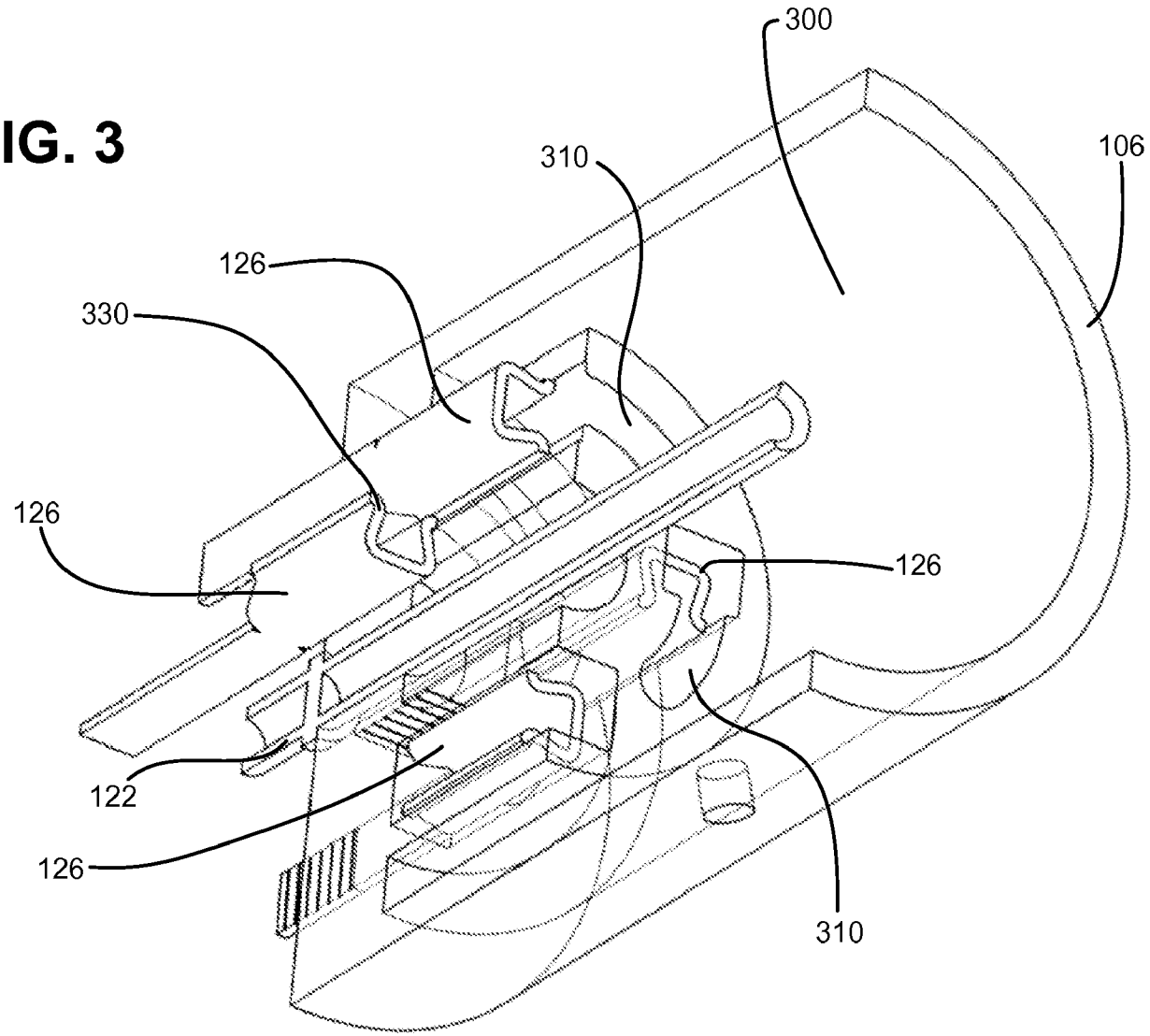
FIG. 3 is an enlarged, cross-sectional isometric view of the first housing and contact assembly of FIG. 1.

First housing 106 may be configured to support or otherwise connect to contact assembly 118. FIG. 3 is an enlarged isometric view illustrating first housing 106, contact assembly 118, center contact sleeve 122, and cup-connectors 126. As illustrated in FIG. 3, first housing 106 may be configured to include cavity 300 for receiving intermediate housing 108 therein, and contact openings 310 and center spring opening 320 therein which engagingly support cup-connectors 126 and center spring 124, respectively. Contact openings 310 may be further configured to include axial grooves to receive connector pins 138 in a first non-connected position. Rotation of connector pins 138 relative to cup-connectors 126 may cause connector pins 138 to move within contact openings 310 and engage with cup-connectors 126.

Consistent with embodiments described herein, center sleeve opening 320 and contact openings 310 may be configured to have a minimal volume for containing environmental air and exhaust gases. For example, center sleeve opening 320 may be configured to closely conform to an outside diameter of center contact sleeve 122. Similarly, contact openings 310 may be configured to closely conform in size to cup-connectors 126 and an outside diameter of connector pins 138. In one exemplary implementation, a total volume of space within center spring opening 320 and contact openings 310 is less than or equal to approximately 10 milliliters (ml). By reducing the volume of gas available within connector 310, the likelihood of an explosion occurring during arcing or flashover (or the severity of such an explosion) is significantly reduced.

Furthermore, as illustrated in FIG. 3, in one exemplary implementation, cup-connectors 126 may be formed of a resilient, conductive material, having a compressed C-shape as indicated by pinched portion 330, in which an open end of cup-connectors 126 is slightly narrower than a width of connector pins 138. The configuration of cup-connectors 126 may provide a snap-engagement with connector pins 138 upon rotational engagement between cup-connectors 126 and connector pins 138. More specifically, the compressed C-shape of cup-connectors 126 allows for a build up of potential energy as connector pins 138 traverse and slightly deform the "arms" of cup-connectors 126 and travel toward pinched portion 330 from within the base of cup connectors 126. Upon reaching the peak of pinched portion 330, the built up potential energy may be released by projecting connector pins 138 out of and away from cup-connectors 126, thus providing a snap disconnect releasing connector pins 138 from cup-connectors 126.

By providing such a snap-engagement between connector pins 138 and cup-connectors 126, the speed in which a connection may be disengaged (or engaged) is significantly increased over non-snap-engagement implementations. This speed increase further reduces a likelihood of arcing or flashover during connection or disconnection of connector 100.

Center contact sleeve 122 may be configured to receive center connector pin 136. Additionally, spring 124 may be positioned about center contact sleeve 122 within center spring opening 320, such that the biasing force of spring 124 urges first housing 106 axially away from intermediate housing 108. As discussed above, the volume of center spring opening 320 as well as contact openings 310 may be reduced to minimize the likelihood that an explosion will occur or the severity of an explosion in the event of arcing or flashover between connector pins 138 and cup-connectors 126.

Contacts 128 may be connected to cup-connectors 126 and center contact sleeve 122. Each contact 128 may be further configured to receive wires or leads that extend through female cover 130. As illustrated in FIG. 2, male connector 104 may include similar contacts.

As illustrated in FIG. 1, first housing 106 may be further configured to include guide pins 120. Guide pins 120 may be positioned such that the inwardly extending ends of guide pins 120 are received within first notched slots 116 in intermediate housing 108. For example, during assembly of female connector 102, intermediate housing 108 may be inserted into first housing 106 prior to insertion of guide pins 120 into corresponding holes in first housing 106.

The size and location of first notched slots 116 may be configured to enable both rotational and axial movement of intermediate housing 108 relative to first housing 106 within a predetermined range of motion. As illustrated in FIG. 1, intermediate housing 108 may be configured to include a notched slot 116 allowing two stages of rotational movement, and one stage of axial movement. Second housing 132 in male connector 104 may be configured to include a similar notched slot 134.

As will be described in additional detail with respect to FIGS. 4A-4D, rotational and axial movement of guide pins 120 within slot 116, as well as corresponding notched slot 134 in male connector 104, may facilitate connection of female connector 102 to male connector 104 in two distinct positions. In a first position, female connector 102 may be connected to male connector 104, but connector pins 138 are not electrically coupled to cup-connectors 126. This may be referred to as the connected—OFF position. In a second position, connector pins 138 may be moved into electrical engagement with cup-connectors 126. This may be referred to as the connected—ON position. As briefly discussed above, the shape of cup-connectors 126 may effectively secure connector pins 138 within cup-connectors 126 upon movement of connectors 102 and 104 from the first position to the second position.

As illustrated in FIG. 2, upon connection of female connector 102 to male connector 104, second housing 132 may become inserted in the gap formed between intermediate housing 108 and first housing 106. Connector 100 may be further configured such that guide pins 120 restrain relative movement between first housing 106, intermediate housing 108, and second housing 132. Because contact assembly 118 is fixed relative to first housing 106 and connector pins 138 are fixed relative to second housing 132, rotation between first housing 106 and second housing 132 effectively brings connector pins 138 into electrical contact with cup-connectors 126. However, because electrical contact is only possible following initial insertion of male connector 104 into female connector 102 in the first (e.g., non connected) position, female cover 130 and male cover 140 may form a contained environment sufficient to minimize an exposure to potentially volatile environmental conditions prior to electrical contact or proximity between connector pins 138 and cup-connectors 126.

As will be discussed below in relation to FIGS. 4A-4E and 5A-5C, interaction of components within connector 100 may provide a flame path for venting of a flame or explosion in the event of an explosion within connector 100. More specifically, elements of intermediate housing 108, female cover 130, and/or male cover 140 may be configured to provide for the venting or extinguishing of any such flame without destroying connector 100 or damaging the surrounding environment or personnel.

Furthermore, spring 124 may provide an opposing force between guide pins 120 affixed to first housing 106 and notched slots 116 in intermediate housing 108. This biasing force may be suitable for preventing or minimizing unintended movement of guide pins 120 relative to notched slots 116 through the positioning and size of the notches in notched slots 116.

Female cover 130 may be formed over first housing 106 and may form a protective covering for female connector 104 as well as approximately one half of the enclosed environment for connector 100 upon connection to male connector 102. In one exemplary implementation, female cover 130 and/or male cover 140 may be formed of a plastic, rubber, or elastomeric material that provides both a high friction, easily grippable surface, in additional to protective insulative properties. In other implementations, female cover 130 and male cover 140 may include a textured or ridges surface to further enhance secure handling and connection of connector 100.

Figures 4A, 4B, 4C, 4D, 4E:
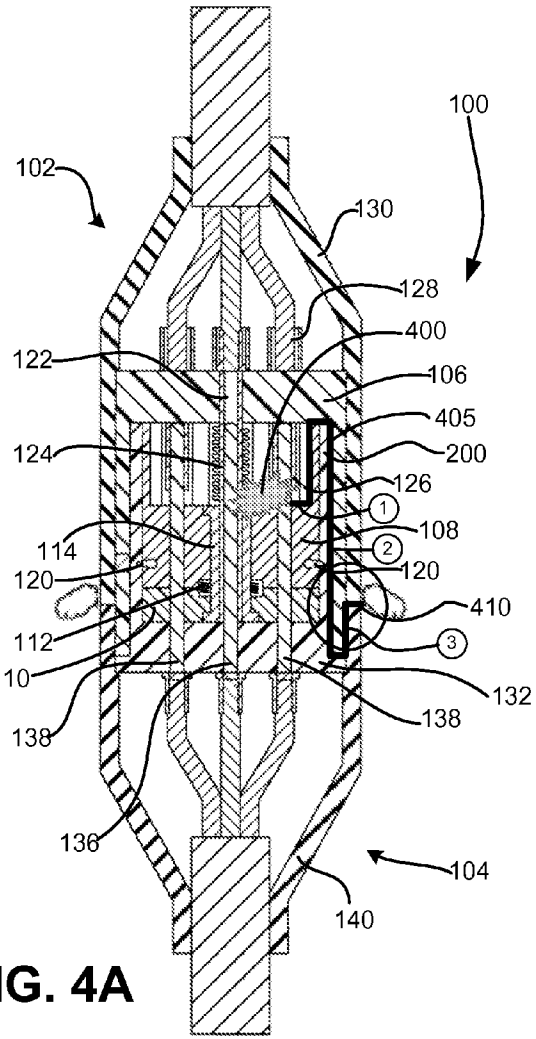
FIGS. 4A-4E are cross-sectional diagrams illustrating exemplary implementations of the connector of FIG. 1.

FIGS. 4A-4E are cross-sectional diagrams illustrating exemplary implementations of the connector 100. In FIG. 4A, an explosion or spark 400 at an interface between connector pin 138 and cup-connector 126 may travel along a flame path 410 provided for in connector 100. As shown, flame path 400 may include interfacing surfaces between first housing 106 and intermediate housing 108 ①, interfacing surfaces between second housing 132 and first housing 106 ②, and interfacing surfaces between first housing 106 and male cover 140 ③. As illustrated, an explosion or spark may travel along flame path 410 and may vent from connector 100 at the interface between male cover 140 and female cover 130. By providing an exhaustible flame path for enabling the release of explosive energy or flames from connector 100, connector 100 may be capable of operating safely in hazardous environments.

FIG. 4B illustrates another exemplary implementation of the interface between male cover 140, female cover 130, and first housing 106. As illustrated in FIG. 4B, a gap 415 may be provided between male cover 140 and female cover 130. Gap 415 may be suitably sized to efficiently enable release of explosive energy or flames from flame path 410 in the event of arcing or flashover within connector 100, as described above in relation to FIG. 4A.

FIGS. 4C and 4D illustrates another exemplary implementation of the interface between male cover 140, female cover 130, and first housing 106. As illustrated in FIGS. 4C and 4D, a male cover 140 may be provided with a hinged portion 420 or flap proximate to the interface with female cover 130. As illustrated in FIG. 4D, in the event of an explosion or flame within flame path 410, hinged portion 420 may open or deform to allow the explosive energy, flames, and/or hot gases to exhaust from connector 100. Although FIGS. 4C and 4D depict hinged portion 420 as being part of male cover 140, hinged portion may also be provided in female cover 140, or in both male cover 140 and female cover 130.

FIG. 4E illustrates yet another exemplary implementation of the interface between male cover 140, female cover 130, and first housing 106. As illustrated in FIG. 4E, male cover 140 and female cover 130 may be configured to overlap. For example, male cover 140 may be provided with an enlarged portion 425 configured to receive female cover 130 in an overlapping manner. In some implementations, female cover 130 may be configured to interlock with enlarged portion 425 to further secure female connector 102 to male connector 104 during connection.

In the event of an explosion or flame within flame path 410, flame path 410 may continue along the interface between enlarged portion 420 and female connector 130 to allow the explosive energy, flames, and/or hot gases to exhaust from connector 100. Enlarged portion 425 may be suitably sized to efficiently enable release of explosive energy or flames from flame path 410 in the event of arcing or flashover within connector 100.

Figure 5B:
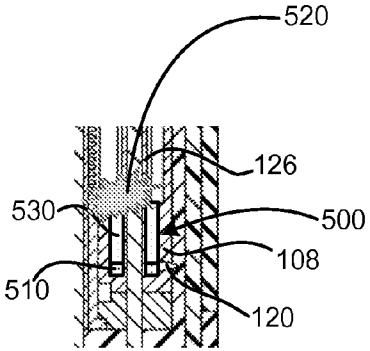
FIGS. 5A-5C are cross-sectional diagrams illustrating additional exemplary implementations of the connector of FIG. 1.
Figure 5C:
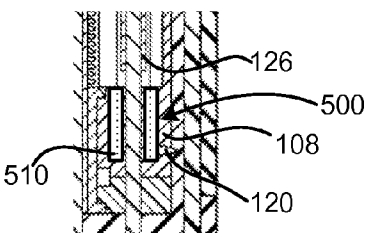
Figure 5A:
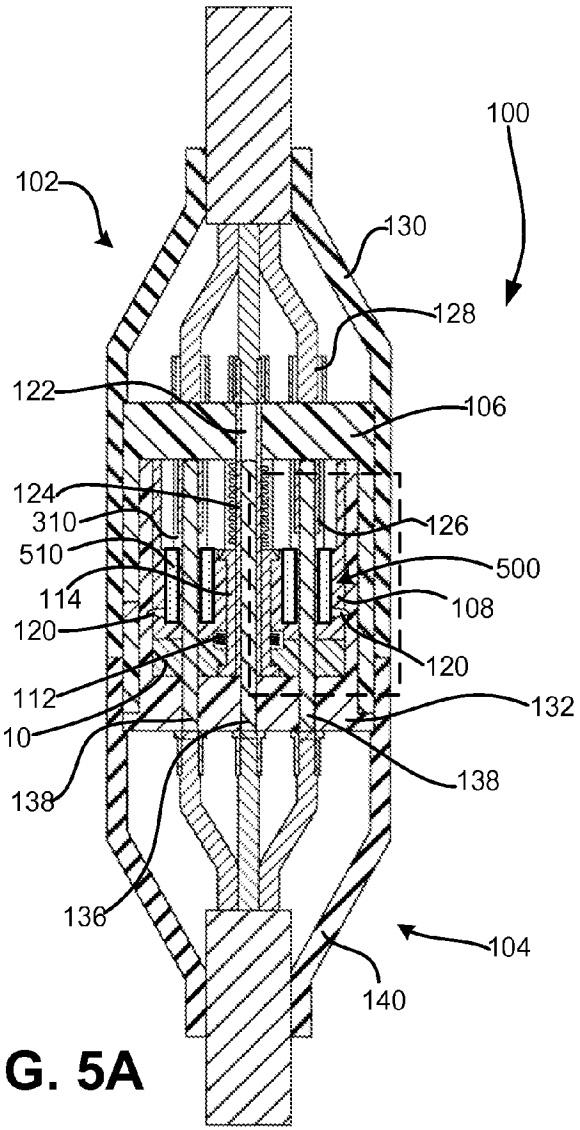

FIGS. 5A-5C are cross-sectional diagrams illustrating additional exemplary implementations of connector 100. As illustrated in FIG. 5A, intermediate housing 108 may include one or more expansion chambers 500 for receiving explosive energy resulting from an explosion or spark experienced at an interface between connector pin 138 and cup-connector. For example, each interface between a connector pin 138 and a cup-connector 126 may be connected to a respective expansion chamber 500, e.g., via conductor opening 310. In one implementation, as illustrated in FIGS. 5A-5C, expansion chambers 500 may include a resilient and/or compressible material 510 configured to compress and absorb explosive energy in the event of an explosion or spark. Compression of material 510 also opens up a volume of expansions chamber 500 thereby allowing explosive energy to dissipate.

As illustrated in FIG. 5A, in an initial, uncompressed state, material 510 substantially fills a volume of each expansion chamber 500. However, as illustrated in FIG. 5B, an explosive event 520, such as an arcing or flashover event, may cause explosive energy or flames to travel from connector opening 310 into expansion chambers 500.

As illustrated in FIG. 5B, the explosive energy may cause a compression of material 510 within expansion chambers 500, to ameliorate or dissipate the explosive energy in expansion chambers 500. Upon dissipation of the explosive energy, material 510 may decompress and refill expansion chambers 500, as illustrated in FIG. 5C.

By providing an expansion chamber having a compressible material there, the embodiment of FIGS. 5A-5C may prevent or minimize damage to connector 100 and/or the surrounding environment resulting from explosive events.

Figures 6A, 6B, 6C, 6D:
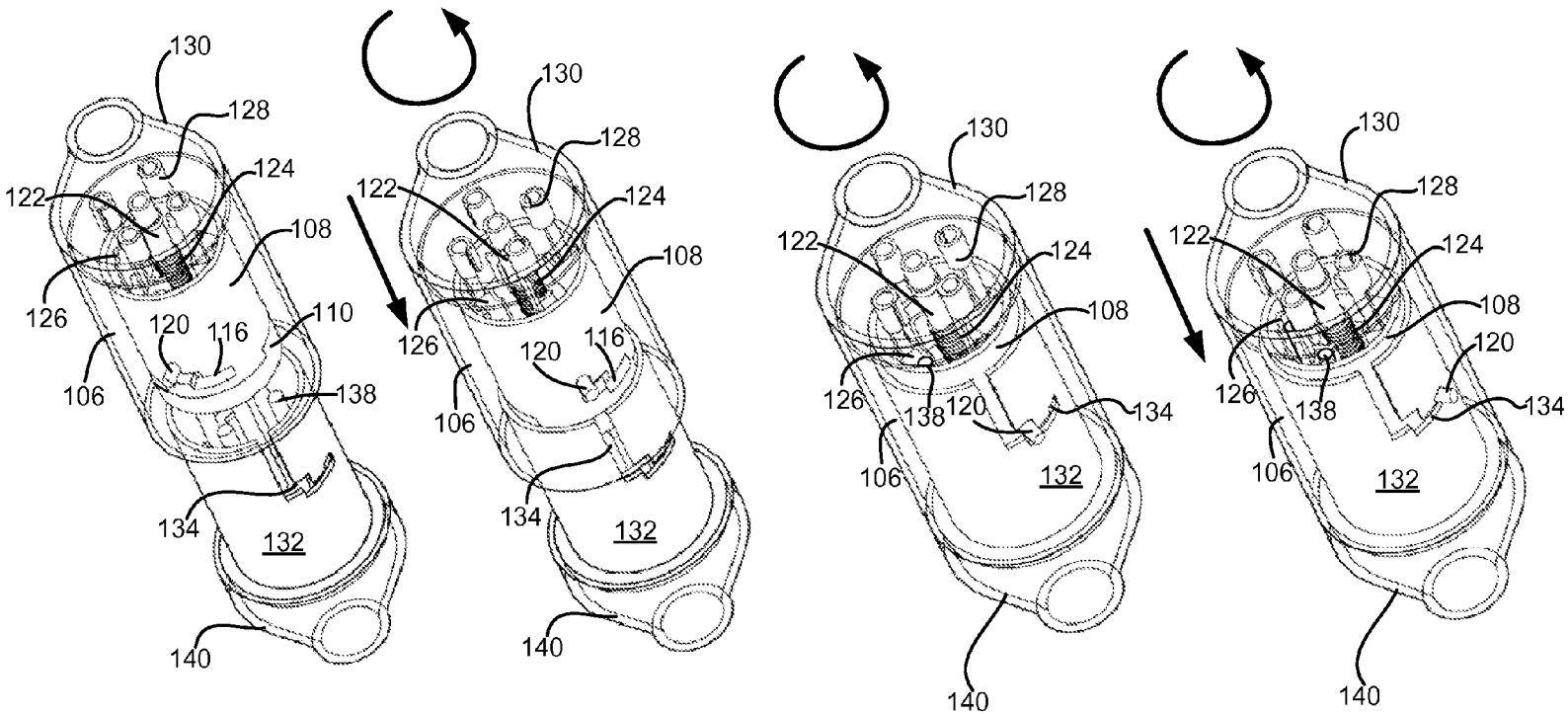
FIGS. 6A-6D are isometric illustrations of the connector of FIG. 1 in various stages of connection.

FIGS. 6A-6D are isometric illustrations of an exemplary connector 100 in various stages of connection. In FIG. 6A, female connector 102 is being brought into initial contact with male connector 104. In FIG. 6B, connector pins 138 have been inserted through dead front 110 and dead front 110 has been rotated relative to intermediate housing 108 to align holes 109 in intermediate housing 108 with holes 111 in dead front 110.

In FIG. 6C, connector pins 138, center connector pin 136, and second housing 132 has been fully inserted into female connector 102. More specifically, connector pins 138 may be received into contact openings 310 in the first position, as described above, center connector pin 136 may be received into center contact sleeve 122, and second housing 132 may be received into the gap formed between intermediate housing 108 and first housing 106.

Moreover, when connector pins 138 are inserted through intermediate housing 108, guide pins 120 become aligned with an exposed opening in second notched slots 134 in second housing 132. Guide pins 120 may travel axially along notched slots 134 until they reach the first notch in notched slots 134. Following axial insertion, rotation of female connector 102 relative to male connector 104 may place guide pins 120 into the first position in notched slots 134 and (not shown in FIG. 6C) notched slots 116.

As described above, the biasing force created by compression of spring 124 between intermediate housing 108 and first housing 106 causes guide pins 120 to remain in the first position in notched slots 116 and 134, rather than travel further axially along notched slots 116 and 134. In this position, a gap remains between female cover 130 and male cover 140 for enabling gases contained within connector 100 to be vented prior to connector 100 being placed into the second position.

FIG. 6C represents connector 100 in the first connected position, in which female connector 102 is securely attached to male connector 104, but connector pins 138 are not in close electrical proximity with cup-connectors 126.

FIG. 6D illustrates connector 100 in the second connected position, in which female connector 102 is securely attached to male connector 104 and connector pins 138 are electrically connected to cup-connectors 126. To enter the second position, female connector 102 is initially moved axially toward male connector 104. This axial movement causes guide pins 120 to travel along notched slots 134 and 116 and also causes female cover 130 to come into contact with male cover 140, effectively sealing the environment in which the electric connection is made. Female connector 102 is then moved rotationally with respect to male connector 104. Upon this rotational movement, connector pins 138 may move within contact openings 310 (shown in FIG. 3) and into electrical contact with cup-connectors 126. As described briefly above, the shape of cup-connectors 126 may cause male connector 104 to snap connect with female connector 102, such that the electrical contact between connector pins 138 and cup-connectors 126 is secure. Axial and rotational movement of female connector 102 relative to male connector 104 is represented by directional arrows in FIGS. 6B-6D.

Because transition from the first connected position to the second connected position can only occur following full insertion of male connector 104 into female connector 102, exposure to outside environmental conditions is minimized or reduced by the interrelation of the components of connector 100, as illustrated in FIG. 2, thus reducing the likelihood of an explosive accident in the event of arcing or flashover.

Figure 7B:
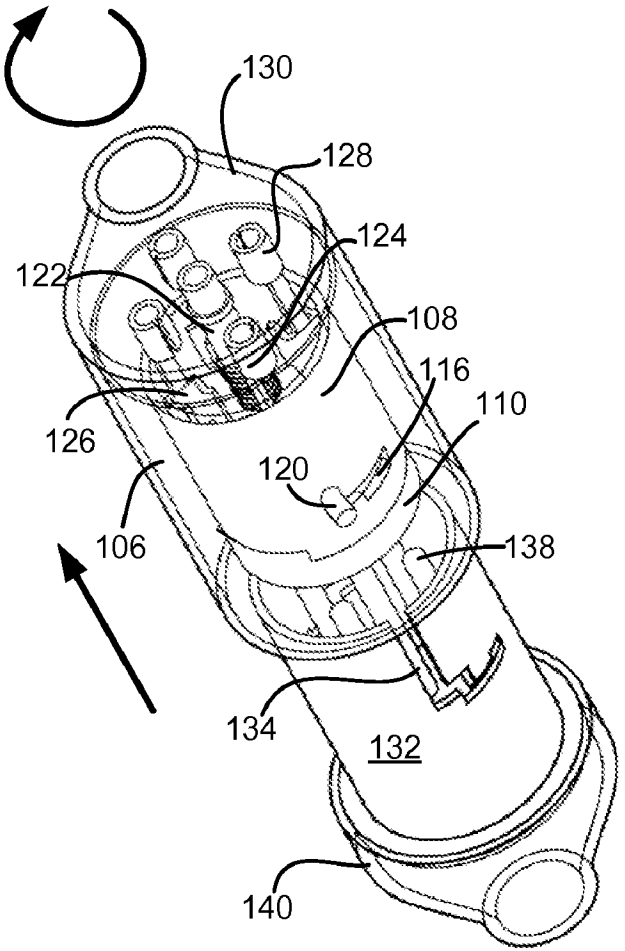
FIGS. 7A and 7B are isometric illustrations of the exemplary connector of FIG. 1 in various stages of disconnection.
Figure 7A:
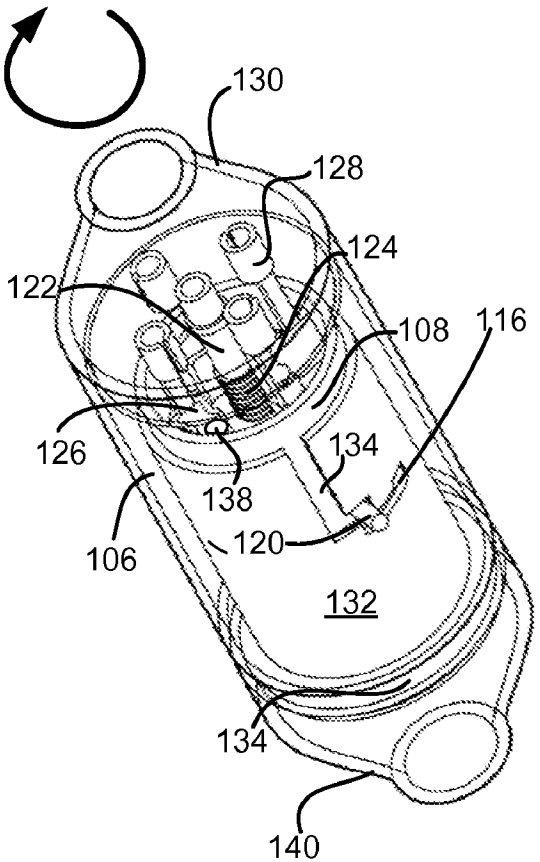

FIGS. 7A and 7B are isometric illustrations of an exemplary connector 100 in various stages of disconnection. In FIG. 7A, female connector 102 is moved rotationally with respect to male connector 104 in a direction opposite to the connection direction as referenced by the directional arrow in FIG. 7A. In one exemplary embodiment, the snap connection created between cup-connectors 126 and connector pins 138 may be disengaged by rotating the female connector 102 relative to the male connector 104 with a predetermined amount of torque. As described above, the C-shape and resilient nature of cup-connectors 126 may cause potential energy to build up as connector pins 138 move out of engagement with cup connectors 126. The potential energy may be released when connector pins 138 pass the narrowest portion of cup-connectors 126, thereby projecting or snap releasing connector pins 138 from cup connectors 126.

Continued rotational movement of female connector 102 relative to male connector 104 causes guide pins 120 to travel along notched slots 116 and 134 until they reach an end of the second notch. The biasing force created by spring 124 then causes female connector 102 to move axially away from male connector 104 and back to the first connected position.

As illustrated in FIG. 7B, female connector 102 is again moved rotationally with respect to male connector 104, causing guide pins 120 to travel along notched slots 116 and 134 until they reach an end of the first notch. Female connector 102 may then be axially removed from male connector 104, thereby freeing guide pins 120 from notched slot 134. Although not explicitly illustrated in FIG. 7B, removal of connector pins 138 from female connector 102 allows dead front 110 to snap back to its resting position, by virtue of dead front spring 112. In this position, the holes in dead front 110 (e.g., holes 111 in FIG. 1) are no longer axially aligned with the holes in intermediate housing 108 (e.g., holes 109 in FIG. 1). In this manner, a user may break electrical contact within connector 100 prior to releasing mechanical attachment between female connector 102 and male connector 104. This may help to prevent electrical current flashover when connector 100 is detached from a live circuit.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to a electrical connectors having four contact pins and a ground pin. In other implementations, any suitable number of contact pins may be used, depending on the type of connector being designed or equipment being used. In some implementations, connector consistent with the above description may be used in various environments and systems, such as, indoor/outdoor lighting systems, conveyors and light motors, assembly plants, processing plants, pulp and paper facilities, sawmills, steel foundries, etc. In addition, the above-described connector may be used in hazardous environments, such as oil refineries, gas processing plants, gas pipelines, chemical manufacturing facilities, etc.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. An electrical connector assembly, comprising:

a first connector including a first housing having a contact; and a second connector configured for connection with the first connector, wherein the second connector includes a second housing having a conductor, wherein the first connector is configured for connection to the second connector in at least a first attached position and a second attached position, where, in the first attached position, the first connector is connected to the second connector, and the conductor of the second connector is not in electrical contact with the contact in the first connector; and where, in the second attached position, the first connector is connected to the second connector, and the conductor of the second connector is in electrical contact with the contact in the first connector.

2. The electrical connector assembly of claim 1, wherein transition from the first attached position to the second attached position is made by axial and rotational movement of the first connector relative to the second connector.

3. The electrical connector assembly of claim 2, wherein the first housing includes a guide pin and wherein the second housing includes a notched slot, wherein the axial and rotational movement of the first housing relative to the second housing is provided by engagement of the guide pin with the notched slot.

4. The electrical connector assembly of claim 3, wherein the notched slot includes a first notch for maintaining the first connector in the first attached position and a second notch for maintaining the first connector in the second attached position.

5. The electrical connector assembly of claim 3, wherein the first connector further comprises an access assembly for restricting access to the contact in the first connector, wherein the access assembly comprises:

an intermediate housing; and a dead front rotatable with respect to the intermediate housing, wherein the dead front includes a hole corresponding to the conductor in the second connector and the intermediate housing includes a hole corresponding to the hole in the dead front, wherein the dead front is rotationally moveable from a first dead front position in which the hole in the dead front is not aligned with the hole in the intermediate housing to a second dead front position in which the hole in the dead front is aligned with the hole in the intermediate housing.

6. The electrical connector assembly of claim 5, wherein the dead front is spring loaded to return to the first dead front position from the second dead front position.

7. The electrical connector assembly of claim 5, wherein the intermediate housing includes a second notched slot corresponding to the notched slot in the second connector, wherein the second notched slot is configured to receive the guide pin.

8. The electrical connector assembly of claim 5, wherein the access assembly is positioned within the first connector such that a gap is provided between the access assembly and the first housing for receiving the second housing therein.

9. The electrical connector assembly of claim 1, wherein the first connector comprises a contact opening for receiving the conductor of the second connector in the first and second attached positions.

10. The electrical connector assembly of claim 9, wherein the contact opening comprises a groove for enabling movement of the conductor from the first attached position to the second attached position contacting the contact.

11. The electrical connector assembly of claim 10, wherein the contact comprises a cup-shape configured to receive the conductor of the second connector upon rotational movement of the conductor within the groove.

12. The electrical connector assembly of claim 11, wherein the cup-shaped contact comprises compressed sidewalls providing for a snap engagement between the cup-shaped contact and the conductor.

13. The electrical connector assembly of claim 1, wherein the first connector further comprises a first cover and the second connector comprises a second cover, wherein the first cover abuts the second cover when the first connector is connected to the second connector.

14. The electrical connector assembly of claim 13, wherein the abutting first cover and second cover form an enclosed environment for the electrical connector.

15. The electrical connector assembly of claim 13, wherein the first cover and the second cover are formed of a resilient insulative material.

16. An assembly, comprising:

a first connector comprising:

a first housing, a contact assembly supported by the first housing, wherein the contact assembly includes at least one contact, and a first insulative cover; and a second connector configured for connection with the first connector, the second connector comprising:

a second housing having at least one conductive pin extending therefrom, and a second insulative cover, wherein the first connector is configured for connection to the second connector in at least a first attached position and a second attached position, and wherein the first insulative cover provides a seal with the second insulative cover in both the first and second positions, wherein in the first attached position, the at least one conductive pin is not in electrical contact with the at least one contact; and wherein, in the second attached position, the at least one conductive pin is in electrical contact with the at least one contact.

17. The assembly of claim 16, wherein the first housing includes a guide pin and wherein the second housing includes a notched slot, wherein transition from the first position to the second position is made by axial and rotational movement of the first connector relative to the second connector via engagement of the guide pin with the notched slot.

18. The assembly of claim 17, wherein the first connector further comprises an access assembly for restricting access to the at least one contact in the first connector, wherein the access assembly comprises:

an intermediate housing rotationally positioned within the first housing; and a spring-loaded dead front rotatable with respect to the intermediate housing, wherein the dead front includes a hole corresponding to the at least one conductive pin and the intermediate housing includes a hole corresponding to the hole in the dead front, wherein the dead front is rotationally moveable from a first dead front position in which the hole in the dead front is not aligned with the hole in the intermediate housing to a second dead front position in which the hole in the dead front is aligned with the hole in the intermediate housing.

19. The assembly of claim 18, wherein the intermediate housing includes a second notched slot corresponding to the notched slot in the second connector, wherein the second notched slot is configured to receive the guide pin.

20. An electrical connector, comprising:

a first connector comprising a housing having a contact opening and at least one contact supported in the contact opening; and a second connector comprising at least one conductive element extending therefrom, wherein the first connector and the second connector include a flame path therethrough for receiving explosive energy resulting from an interaction between the first connector and the second connector wherein the first connector further comprises a first cover and the second connector comprises a second cover;

wherein the first cover abuts the second cover when the first connector is connected to the second connector;

wherein the first cover includes a hinged portion configured to open at the abutment between the first cover and the second cover; and wherein the flame path is vented at via the hinged portion.

21. The electrical connector of claim 20, wherein the contact opening includes a volume sufficiently small to reduce a likelihood of a damaging explosive event.

22. The electrical connector of claim 21, wherein the volume is less than or equal to approximately 10 milliliters.

23. The electrical connector of claim 20, wherein the flame path is vented at an interface between the first connector and the second connector.

24. The electrical connector of claim 23, wherein the first connector further comprises a first cover and the second connector comprises a second cover, wherein the first cover overlaps the second cover when the first connector is connected to the second connector, and wherein the flame path is vented at an interface between the first cover and the second cover.

25. The electrical connector of claim 20, wherein the flame path comprises:

an expansion chamber provided at an interface between the first connector and the second connector.

26. The electrical connector of claim 25, wherein the expansion chamber includes a compressible material therein.

* * * * *